US008616802B2

(12) United States Patent
Gerrard et al.

(10) Patent No.: US 8,616,802 B2
(45) Date of Patent: Dec. 31, 2013

(54) SECURITY BARRIER POSTS, SECURITY BARRIERS AND METHODS OF BUILDING SECURITY BARRIERS

(76) Inventors: Robert Gerrard, Coventry (GB); Marcus Gerrard, Coventry (GB)

( * ) Notice: Subject to any disclaimer, the term of this patent is extended or adjusted under 35 U.S.C. 154(b) by 47 days.

(21) Appl. No.: 13/147,154

(22) PCT Filed: Jan. 11, 2010

(86) PCT No.: PCT/GB2010/000037
§ 371 (c)(1),
(2), (4) Date: Aug. 23, 2011

(87) PCT Pub. No.: WO2010/086581
PCT Pub. Date: Aug. 5, 2010

(65) Prior Publication Data

US 2011/0293366 A1 Dec. 1, 2011

(30) Foreign Application Priority Data

Jan. 31, 2009 (GB) ..... 0901596.7
Jul. 13, 2009 (GB) ..... 0912093.2

(51) Int. Cl.
*E01F 15/02* (2006.01)

(52) U.S. Cl.
USPC ..... 404/6; 404/10; 256/13.1

(58) Field of Classification Search
USPC ..... 40/607.01, 607.05, 612; 404/6, 10; 256/13.1
See application file for complete search history.

(56) References Cited

U.S. PATENT DOCUMENTS

| | | | | |
|---|---|---|---|---|
| 380,627 | A | 4/1888 | Harmon et al. | |
| 1,359,704 | A | 11/1920 | Howell | |
| 2,013,716 | A * | 9/1935 | McFadden et al. | 256/13.1 |
| 2,646,969 | A * | 7/1953 | Hendrickson | 256/13.1 |
| 2,988,332 | A * | 6/1961 | Giulio | 256/13.1 |
| 3,077,339 | A * | 2/1963 | White | 256/13.1 |
| 3,727,357 | A | 4/1973 | Stillman, Jr. | |
| 4,365,451 | A | 12/1982 | Nelson | |
| 4,443,002 | A * | 4/1984 | Fontana | 256/59 |
| 4,635,905 | A * | 1/1987 | Fontana | 256/65.01 |
| 5,396,743 | A | 3/1995 | Bellette | |
| 5,975,808 | A | 11/1999 | Fujita | |
| 6,488,268 | B1 | 12/2002 | Albritton | |
| 6,935,622 | B2 * | 8/2005 | Jonsson et al. | 256/13.1 |
| 7,677,533 | B2 * | 3/2010 | Fracasso et al. | 256/13.1 |
| 2002/0088186 | A1 | 7/2002 | Cusimano et al. | |
| 2002/0179894 | A1 | 12/2002 | Albritton | |
| 2003/0197162 | A1 | 10/2003 | Albritton | |

(Continued)

FOREIGN PATENT DOCUMENTS

| | | |
|---|---|---|
| AU | 2008249195 | 7/2009 |
| DE | 3926294 A1 | 2/1990 |

(Continued)

*Primary Examiner* — Gary Hartmann
(74) *Attorney, Agent, or Firm* — Wells St. John P.S.

(57) ABSTRACT

An security barrier underground footing (12), and a security barrier post (10) are provided. The footing (12) comprises a substantially vertical shaft (16) having a back plate (14) and a foot plate (18) both arranged substantially perpendicular to the shaft (16) and extending to at least one side thereof. In use, the footing (12) is at least partially buried. The back plate (14) is attached to the rear facing side of the shaft (16) away from which an impact will occur and is located at a position that, in use, is flush with or slightly below a surface in which the footing (12) is buried, and the foot plate (18) is towards the lower end of the shaft (16), at a position spaced from the back plate (16).

25 Claims, 19 Drawing Sheets

(56) References Cited

U.S. PATENT DOCUMENTS

| | | | | |
|---|---|---|---|---|
| 2004/0086334 | A1* | 5/2004 | Kamarata | 404/6 |
| 2008/0112756 | A1 | 5/2008 | Omar | |
| 2011/0024707 | A1* | 2/2011 | Williams et al. | 256/13.1 |

FOREIGN PATENT DOCUMENTS

| | | | |
|---|---|---|---|
| DE | 29916623 | | 1/2000 |
| EP | 0222954 | | 5/1987 |
| EP | 0969149 | | 1/2000 |
| EP | 1892333 | | 2/2008 |
| GB | 2 148 358 | * | 5/1985 |
| GB | 2267102 | | 11/1993 |
| GB | 0901596.7 | | 5/2009 |
| GB | 1000383.8 | | 4/2010 |
| WO | WO2006/087560 | | 8/2006 |
| WO | PCT/GB2010/000037 | | 4/2010 |

* cited by examiner

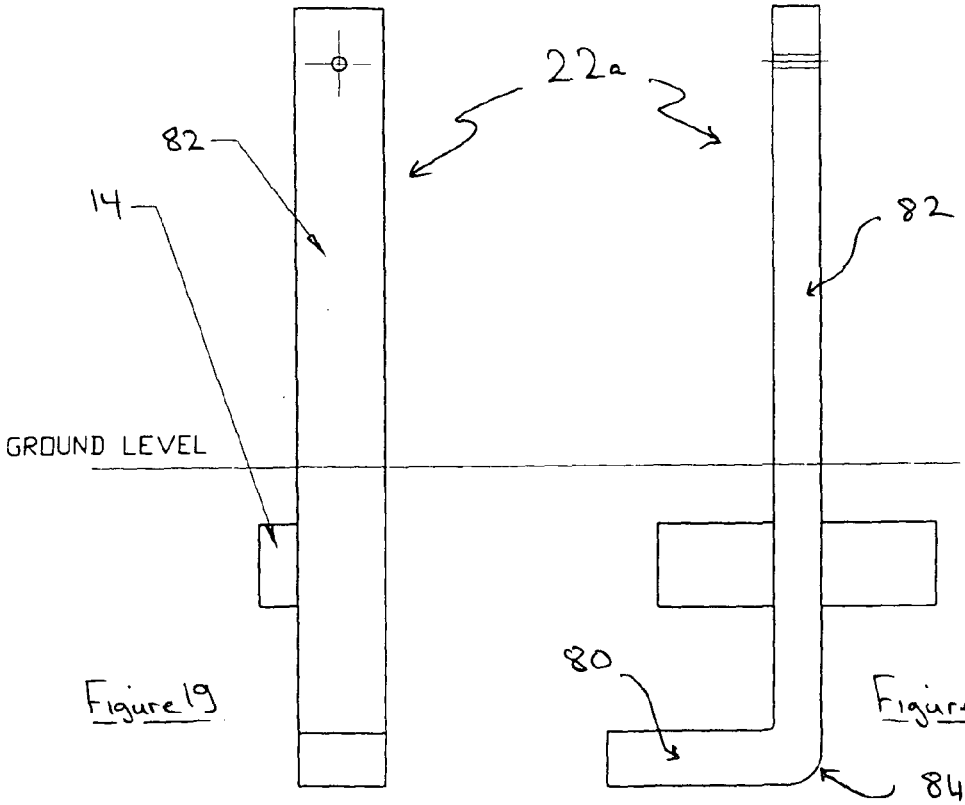
Figure 19
Figure 20
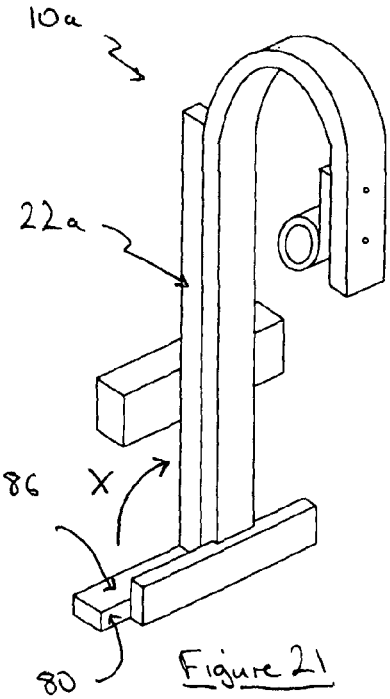
Figure 21
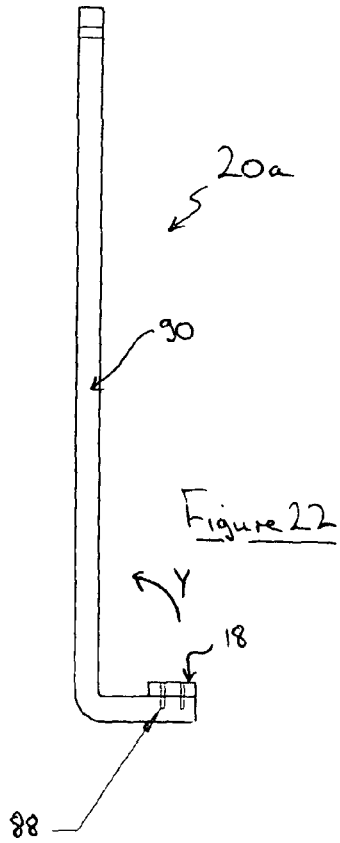
Figure 22

SECURITY BARRIER POSTS, SECURITY BARRIERS AND METHODS OF BUILDING SECURITY BARRIERS

CROSS REFERENCE TO RELATED APPLICATION

This application is a 35 U.S.C. §371 of and claims priority to PCT International Application Number PCT/GB2010/000037 (Publication No. WO 2010/086581 A1), which was filed 11 Jan. 2010, and was published in English, and this application claims priority to UK Patent Application No. 0901596.7 which was filed 31 Jan. 2009, and UK Patent Application No. 0912093.2 which was filed 13 Jul. 2009, the teachings of which are incorporated herein by reference.

This invention relates to security barriers and posts for security barrier, in particular to underground post footings for security barrier posts.

Security barriers, or crash barriers, the main purpose of which being to prevent the passage of vehicles, are widely known in the art and have many applications. Common applications are for bordering dangerous sections of roads, providing a central separation between lanes of traffic moving in opposite directions and around secure areas, for example around the entrance to airports or the like.

Known security barriers are generally made of metals, in particular steel, and comprise a post, which is bedded in concrete, to which a barrier is attached. To provide the structural integrity to stop a car moving at around 40 to 50 km/h such barriers need a very deep reinforced bedding of around a meter in depth and, for larger trucks a bedding of up to two meters, into which the posts are set, is needed. As well as the obvious disadvantages in terms of the amount of material needed and the increased complexity of excavating to the required depth, the necessity of burying the posts to such a depth often interferes with existing buried services, for example electricity cables and sewage or water pipes. Although many are marked and can be anticipated during the planning stage, the discovery of pipes during deep excavation is common and necessitates halting excavation until the nature of the pipe/cable has been ascertained.

Further more, even when bedded deeply into concrete, the loads exerted on the concrete by the post, as it is struck, can cause damage to the concrete bed reducing the strength of the barrier against future impacts unless re-worked.

As security measures are heightened in response to such threats as terrorism at airports it is increasingly important to prevent "punch through" by vehicles, that is to have barriers that prevent a first vehicle breaking the structural integrity of a barrier such that a second vehicle, following the first vehicle, can pass through the barrier by pushing the first vehicle out of the way. As such the permanent deformation of existing barrier posts or damage to the concrete in which they are bedded is highly undesirable.

Furthermore, as a result of increased security threats additional security barriers are being introduced in many new places, the excavation of the footings for which is highly disruptive.

The present invention attempts to mitigate at least some of the above mentioned problems by providing an improved crash barrier with facilitated installation.

According to a first aspect of the invention there is provided a security barrier underground footing comprising:

a substantially vertical shaft having a back plate and a foot plate both arranged substantially perpendicular to the shaft and extending to either side thereof, wherein in use, the footing is at least partially buried;

the back plate is attached to the rear facing side of the shaft away from which an impact will occur and is located at a position that, in use, is flush with or slightly below a surface in which the fooling is buried, and wherein the foot plate is towards the lower end thereof, at a position spaced from the back plate.

A footing according to this design can withstand an impact of a much greater force than a standard post footing of he same depth. The back plate and the foot place create large resistances against the movement of the post through the ground in which it is buried and are positioned such that their joints with the shaft are in compression when a security barrier having such a footing is struck. In use force from an impact will be transferred from the front of the post into the back plate The back plate prevents the post from cutting into the ground in which it is embedded and the force is transferred down the shaft to also act on the foot plate.

Preferably the back plate and/or the foot plate is constructed of spring steel. In this manner, as force is transferred into the footing some of the energy is transferred into stored potential energy in the spring steel. Furthermore, if the material in which the footing is buried does give around the footing, in comparison to normal steel which would deform into a V shape at the point of contact with the shaft thereby concentrating the pressure into a single point on both the first and on consecutive impacts, the use of spring steel in the present invention allows the front plate and back plate to flex upon impact without permanently deforming in the manner of, for example, mild steel and is thereby able to receive consecutive impacts without readily ripping out of the ground.

In a preferred arrangement the footing comprises a section that extends substantially vertically above the ground, the above ground section having a vertical support plate attached to a rear facing surface thereof, the plate extending in a rearward direction therefrom, and arranged such that the lower edge of the plate is adjacent to, or partially embedded in, the surface in which the footing is buried. The support plate may have a load distribution plate attached to the lower edge thereof substantially horizontal to the ground such that any force transmitted through the support plate into the distribution plate acts in a substantially downwardly direction and acts over the area of the distribution plate.

By attaching a support plate to the section of the footing above the ground, when impacted a force will be transferred through the back edge of the footing, through the support plate and into the ground. The reactant force will act in the opposite direction and give support to the back of the post and help to prevent damage thereto. Where the footing extends above ground level, there is a possibility that the force exerted on the back edge of the footing could cause it to damage or split open, depending on the magnitude of the impact. Provision of the support plate supports the shaft of the footing in this area and helps prevent such damage occurring. Furthermore, the combination of the footing and the support plate effects a reliable a footing that extends above the level of the surface in which it is partially buried which enables a barrier post to be provided which has an even shallower footing, which may only be 100 mm to 200 mm, which is effective for lighter weight security barriers, for example for stopping slow moving vehicles in car parks. The additional load distribution plate spreads the force over a wider area thereby reducing the pressure exerted by the support plate onto the surface on which it acts.

In a preferred arrangement the footing comprises a front section and a rear section, the foot plate being attached to the front section and the back plate being attached to the rear section. The rear section may comprise a substantially vertically arranged piece of spring steel, the lower end of which is bent through substantially 90 degrees such that it extends therefrom substantially parallel to the back plate.

In this manner the resistance to impact of the post is improved. The bent section of the rear section helps to prevent the post from lifting from the ground and, furthermore, resists sideways rotation of the post in the case that the post is impacted at an angle.

In one arrangement the front section comprises a substantially vertically arranged piece of spring steel. Preferably the lower end is bent through substantially 90 degrees such that it extends therefrom in the impact facing direction. Preferably the foot plate is attached substantially at the end of the bent section. More preferably the foot plate is arranged such that its face having the largest surface area is horizontal.

In this manner the footing has a greater increased resistance to impact. Forwardly bent section of the front section, together with the front plate operates in a first mode as described above, and operates in a second mode in which it prevents rotational movement of the footing about its lower point.

The footing may further comprise a load plate substantially perpendicular to, and adjoining, the distil end of the sideways extending lower end.

In one preferred embodiment the footing comprises a second back section, the extended lower end of the two back sections extending in opposite directions.

In a further arrangement the footing may include an underground rear support plate attached to a rear facing surface thereof, the plate extending in a rearward direction therefrom. The support plate may have a first load distribution plate attached to the lower edge thereof substantially horizontal to the ground, and may have a second load support distribution plate attached to the rear edge thereof substantially horizontal to the ground such that that both the horizontal and vertical component forces of any impact transmitted through the support plate into the distribution plates acts over an enlarged surface area.

By spreading the load of impact, and firmly rooting the footing in the ground a spring steel post secured by the footing can act in the manner in which it is intended in that the spring steel can resiliently absorb the impact without ripping from the ground without the need for very deep footings and very large masses of reinforced concrete.

Some or all of the various details of the first embodiment described above may be used in combination with one another in any practical arrangement In a preferred embodiment the front section has a recess on its forward face towards the lower end thereof and the front plate is located at least partially within said recess, in this manner vertical forces can be directly transferred between the parts without the reliance on mechanical coupling means, e.g. bolts, which, when used to transfer force would be subject to shear forces that may cause failure.

According to a second aspect of the invention there is provided a security barrier post comprising a footing according to the first aspect of the invention and a barrier post that extends above the surface in which the footing is buried Preferably the barrier post is made of spring steel. In a preferred embodiment the barrier post comprises a plurality of vertical elements aligned between the impact facing side of the shaft and the side of the shaft away from which, in use, an impact will occur. More preferably vertical elements are made of spring steel and are only joined together at a lower end thereof. In this manner when the barrier is struck the posts can flex, and absorb some of the impact, with out becoming structurally compromised. As multiple vertical elements of the barrier post are not attached together at their upper ends, as the multiple elements flex under impact their surfaces can slide against one another thereby further absorbing impact energy.

In a preferred embodiment the footing and barrier pos are integral. More preferably the vertical elements may comprise extensions of the front section and the back section.

The back section may extend substantially vertically above the front section or alternatively the front section may extend substantially vertically above the back section.

Preferably the barrier post is substantially in the shape of an inverted hook, the bend of the hook extending from the direction of the footing towards the direction from which, in use, impact will occur. In this manner the initial force of the impact is absorbed by the bend of the hook shape flexing, is further absorbed by the barrier post flexing and, finally, by the back plate and the foot plate flexing. The extent to which the different parts will flex will be dependant upon the force of the impact. In a preferred arrangement the end of the hook shaped section extends inward on itself towards the direction of the footing. The extent to which it extends inwardly can be modified to effect the extent of flexure of the bend of the hook shaped element.

Where the footing and barrier post are integral and the barrier post comprises a plurality of vertical elements aligned between the impact facing side of the shaft and the side of the shaft away from which, in use, an impact will occur, the foot plate is attached to the foremost vertical element on the impact facing side of the shaft and the back plate the is attached to the rear of the aft most vertical element from the impact facing side.

According to another preferred embodiment the shaft of the footing comprises a hollow section for receiving the barrier post therein. The hollow section may be any cross section but is preferably either tubular for receiving a round barrier post, or is of rectangular box section for receiving a barrier post, having a rectangular cross section, therein.

In one preferred arrangement the shaft may be made of spring steel. In this manner the hollow shaft may resiliently flex in its cross section when stressed by impact forces being transmitted through the barrier post. This helps to prevent the barrier post from ripping open the tubular shaft under impact.

In one preferred embodiment the security barrier post further comprises attachment means for attaching a secondary post thereto. Preferably the security barrier post also comprises an elongate secondary post, attached to the security barrier post, the secondary post extending substantially vertically above the security barrier post.

According to a third aspect of the invention there is provided a security barrier comprising a plurality of security barrier posts according to the second aspect of the invention.

The security barrier posts may be covered so as to disguise their function. The coverings may be purely aesthetic or may further function as displays for advertising or the like.

Preferably the security barrier further comprises a barrier section joining the posts above the ground. Adjacent back plates and/or foot plates may be joined to one another, furthermore, adjacent back plates and/or foot plates may be integral.

In one arrangement the security barrier comprises a plurality of security barrier posts having secondary posts extending therefrom and a secondary barrier attached to the secondary posts.

In a preferred arrangement the security barrier comprises two rows of security barrier posts wherein, the security barrier posts in adjacent rows are staggered from one another. In this manner larger and heavier vehicles may be stopped and by staggering the posts small vehicles such as wheelchair can negotiate between the posts while ensuring that the impact is spread over more than one post.

According a forth aspect of the invention there is provided a method of building a security barrier, the method comprising the steps of:

excavating a shallow trench, locating at least one barrier post footing according to the first aspect of the invention within the trench such that the footing of the post is at least partially within said trench;

inserting reinforcement cages to either side of said at least one post such that adjacent cages overlap one another in the region of, or adjacent to, said footing; and filling the trench with concrete to form a concrete bed such that the back plate of the footing is located at a position that is flush with or slightly below a surface of said concrete.

In a preferred arrangement the reinforcement cages comprise a rectangular tubular structure having a surface comprising a rectangular gridwork of steel reinforcement bar. Preferably the longitudinal reinforcing bars (running in a direction along the length of the trench) of each reinforcement cage extend either end thereof such that when two reinforcement cages are positioned adjacent one another the longitudinal reinforcement bars overlap.

In this manner a security barrier of any length can easily and quickly be assembled from as it is constructed in a modular manner. Accordingly a long barrier can be installed in sections as the reinforcement is modularised into small manageable pieces.

Furthermore, the reinforcing cages can be fabricated away from the installation site, thereby reducing time needed on location to install the barrier.

In a preferred arrangement the concrete bed in which the post footing is located is approximately 400 mm deep. Due to the improved stress distribution within the footing, and the improved transfer of this impact stress to the concrete, by maintaining a shallow trench depth the majority of underground services can be avoided during the installation process, the combination of the post design and the reinforced bed enabling the required impact resistance to be achieved in a shallow footing.

In a preferred arrangement the post footing is located in the forward half of the concrete bed, more preferably it is located at a position approximately one third of the way across the concrete bed, from the side of perceived impact.

According to a fifth aspect of the invention there is provided a modular security barrier system comprising:

a plurality of security barriers posts according to the second aspect of the invention;

a plurality of reinforcement cages, each comprising a plurality of cross members and a plurality of longitudinal members, said longitudinal members extending from at least one side of the cross members of each cage; wherein when assembled the longitudinal members of one reinforcement cage overlap with the longitudinal members of an adjacent reinforcement cage.

In a preferred embodiment the cross members are substantially rectangular and are constricted of steel. Preferably the longitudinal members extend along the corners of the rectangular cross members. A plurality of longitudinal members may extend across the upper surface of the reinforcement cages.

Preferably the longitudinal members extend to both sides of said reinforcement cage, and when assembled the longitudinal cross members of one reinforcement cage overlap with the longitudinal cross members of an adjacent reinforcement cage.

Specific embodiments of the invention will now be described, by way of example only, in which:

FIGS. 19 and 20 show front and side views of a rear section of a footing in accordance with the invention;

FIG. 21 shows a security barrier post having the rear section shown in FIG. 19;

FIG. 22 shows a front section of a footing in accordance with the invention;

Figure 1:
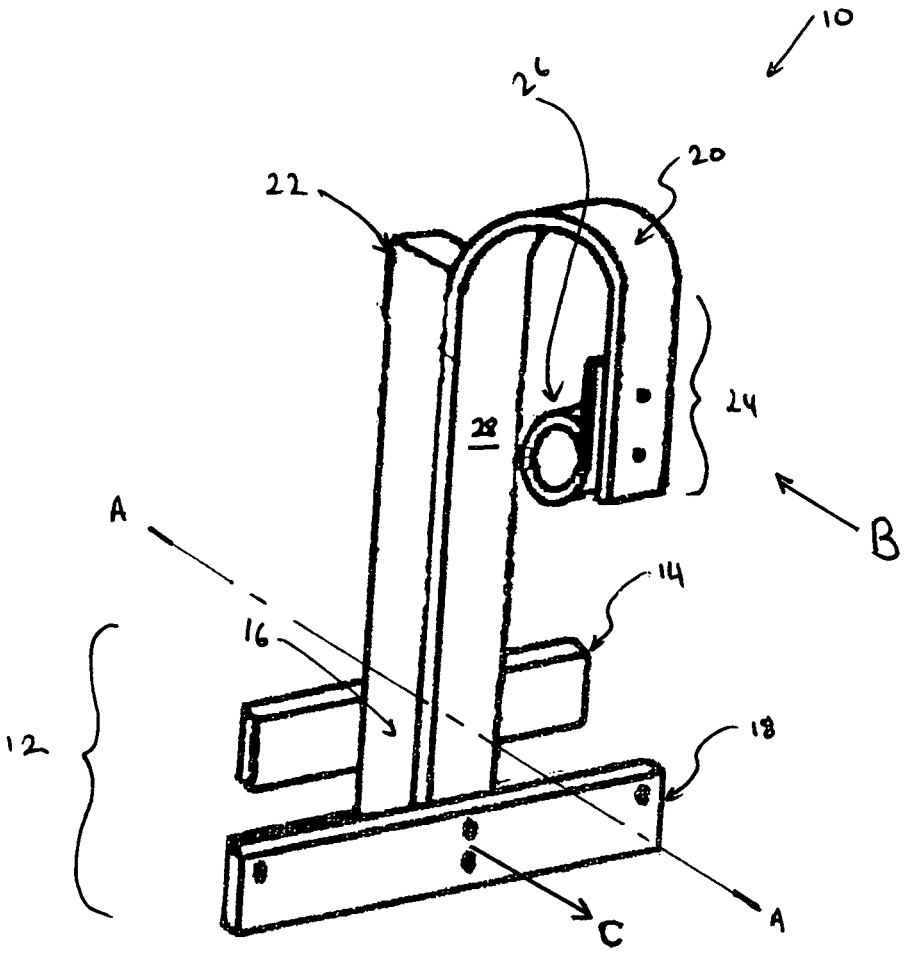
FIG. 1 shows a perspective view of a security barrier post in accordance with the invention.

Referring to FIG. 1 security barrier post 10 is shown. The barrier post has an integral footing 12 below the line A-A. In use the footing 12 of the barrier post 10 is embedded in the ground, preferably in concrete.

The footing 12 has a back plate 14 attached to a shaft 16 at a position that, in use, is just below the ground level. The post 10 is designed to absorb an impact from the direction depicted by arrow B and the base plate 12 is located at the rear of the shaft 16 with respect to the impact direction.

The footing 12 also has a foot plate 18 attached to its lower end on the side facing the direction of impact. When impacted by a force in the direction B the post will try to pivot about an axis passing along the rear face on the back plate 14. As the back plate 14 presents a large surface area the backwards movement of this part of the footing is restricted at this point. In turn this results in a force being transmitted through the shaft 16 and into the foot plate 18 which tries to force the foot plate 18 in direction C. As the foot plate 18 presents a large surface area the forwards movement of the footplate, and therefore the base of the shaft 16, is reduced or prevented.

As the shaft 16 exerts a backwards force on the base plate 14 and a forwards force on the foot plate 18, the joints between the shaft 16 and the plates 14, 18 are in compression and therefore do not become fatigued.

The plates 14, 16 are made of spring steel which, if there is any movement in the material in which the footing 12 is embedded, enables them to flex into a curved shape along their length without suffering any significant permanent deformation. Once the force of the impact has subsided, the spring steel returns to its original shape and the structural integrity of the footing 12 is largely maintained.

The upper section of the barrier post 10 extends above the ground in a largely "inverted hook" shape. The post comprises two sections, a front section 20 and a rear section 22. Both the front section and the rear section are made of spring steel. The front section comprises an "inverted hook" shaped structure and, in use, a security barrier is attached to the outer surface of the "hook". Under impact, initially the bend of the hook will flex as section 24 is pushed back. As the front section 20 is made of spring steel it will resist this movement but, as the font section is relatively thin in comparison to the rear section it will not have a great resistance. In very light collisions primarily this front section will deflect thereby absorbing the impact. In a collision with greater force the front section 20 will deform until limiter 26 abuts face 28. At this point the force of the impact will be directly transferred into the rear section 22 which is of a greater thickness.

The rear section 22 may be a single piece of spring steel as depicted or can be a leaf spring having several layers of spring steel. If a multi layered arrangement is used the layers are adjacent one another but are not attached to one another, thereby allowing adjacent surfaces to slide over one another as they deflect along their length. Such a construction is similar to that shown in FIGS. 9 and 10.

In very forceful impacts, the force of impact will cause some movement in the material in which the footing is embedded. In this case the back plate and the foot plate will deform into an arcuate shape as the shaft 16 transmits the force onto their centres. Once the force of the impact has been removed, the barrier post 10 will substantially return to its original position.

Depending on the force of the impact there may be some permanent deformation of the barrier but due to its multi energy absorbing structure, under the same impact force it can retain a far greater structural integrity than a standard security barrier post. This can help prevent the cumulative effect of multiple impacts as, at the time of further impacts, the post has retained a far greater structural integrity.

Figure 2:
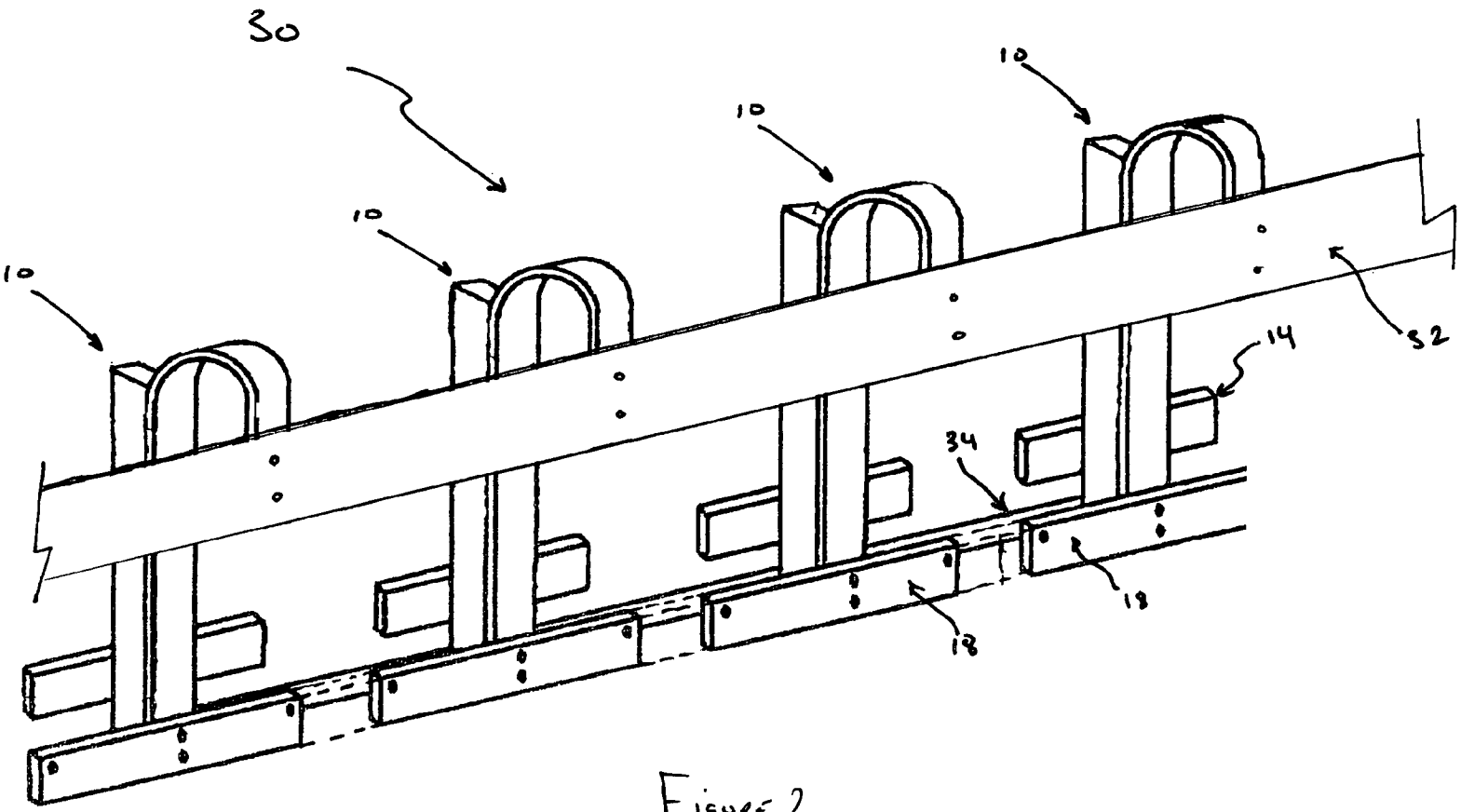
FIG. 2 shows a perspective view of a security barrier according to the invention.

Referring to FIG. 2 a crash barrier 30 is shown comprising a plurality of barrier posts 10 (as described above), to which is attached a barrier plate 32. The barrier plate 32 is also made of spring steel and, although depicted here as a single flat strip for simplicity, may comprise a number of strips or may have a profiled cross section as is well known in the art. The barrier plate 32 may be attached to the barrier posts 10, e.g. by bolts, or may alternatively be loosely attached by passing it through U-bolts, or by passing a barrier through eyes on the end of the hooks (see FIG. 16). By not fixing the barrier rigidly to each security post, the barrier has a degree of freedom of movement along its axis such that when impacted it can move axially relative the barrier posts. The barrier posts are separated at a distance of 1000 mm to 1200 mm such that a vehicle striking the barrier straight on will impact directly on at least one barrier post.

Adjacent foot plates 18 may be joined together by joining sections 34 which may be attached by any conventional means to the foot plates 18. Alternatively, adjacent foot plates 18 may be integral to one another so as to form a strip (as depicted by the dashed lines) thereby helping to spread the force of an impact over a larger area. The back plates 14 may also be joined, or integral, in a similar manner.

Figure 3:
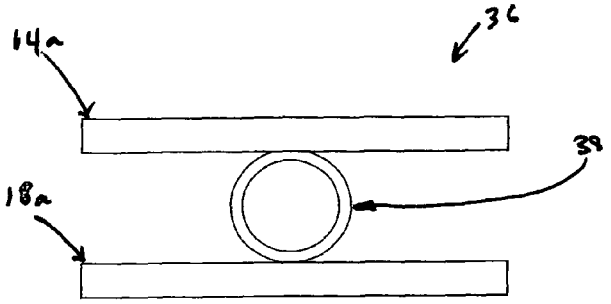
FIGS. 3 to 5 show top, front, and side views of a footing having a circular tubular shaft.
Figure 4:
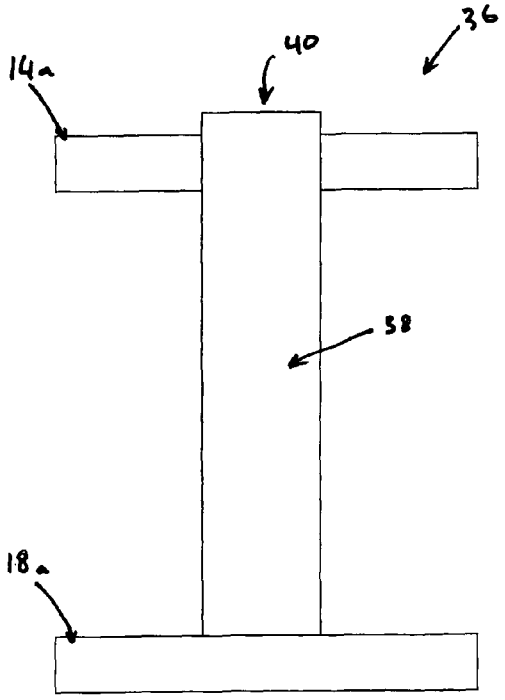
Figure 5:
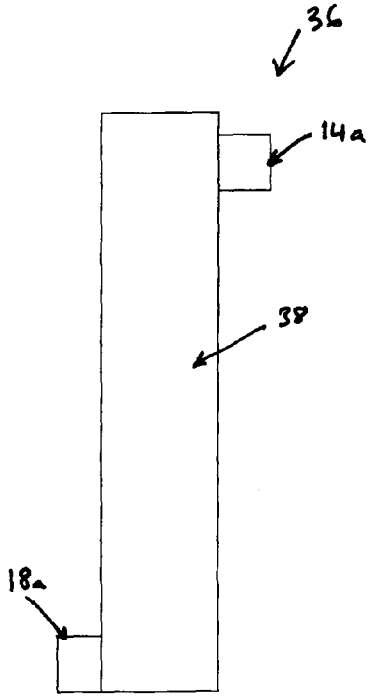

Referring to FIGS. 3 to 5 top, front and side views, respectively, of a footing of a security barrier are shown. The footing 36 comprises a tubular shaft 38 for receiving a barrier post of a security barrier and has a back plate 14*a* and a foot plate 18*a* attached thereto. The tubular shaft 38, the back plate 14*a* and the foot plate 18*a* are made of spring steel. In use the footing 36 is embedded in the ground, or in a specific bedding material, for example concrete, such that the top surface 40 of the shaft 38 is substantially flush with the ground. The top surface may, of course, be recessed into the ground or extended above the ground so long as the top edge of the back plate 14*a* is substantially flush with, or adjacent to and slightly below, ground level. In use, the tubular shaft 38 accepts a barrier post of a security barrier therein and the combined barrier post and footing function substantially as described in relation to FIG. 1.

Figure 6:
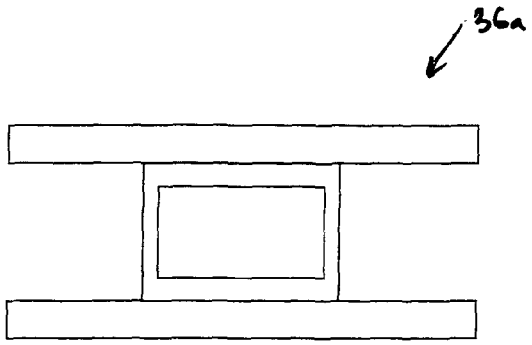
FIGS. 6 to 8 show top, front and side views of a footing having a rectangular tubular shaft.
Figure 7:
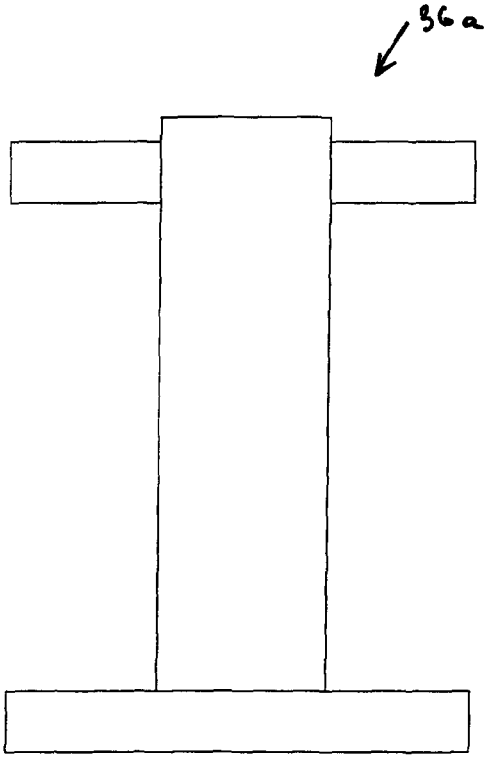
Figure 8:
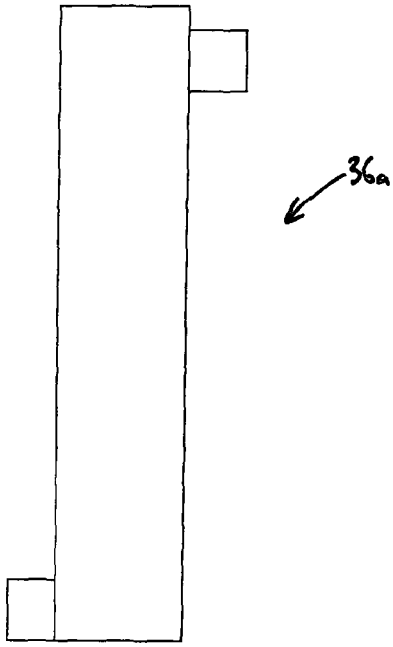

Referring to FIGS. 6 to 8, top, front and side views, respectively, of a similar footing 36*a* are shown. Footing 36*a* differs in that instead of a cylindrical tubular shaft, the shaft of footing 36*a* comprises a rectangular box section which is made of spring steel. As such it can receive a rectangular barrier post as shown in FIGS. 9 and 10.

Figure 9:
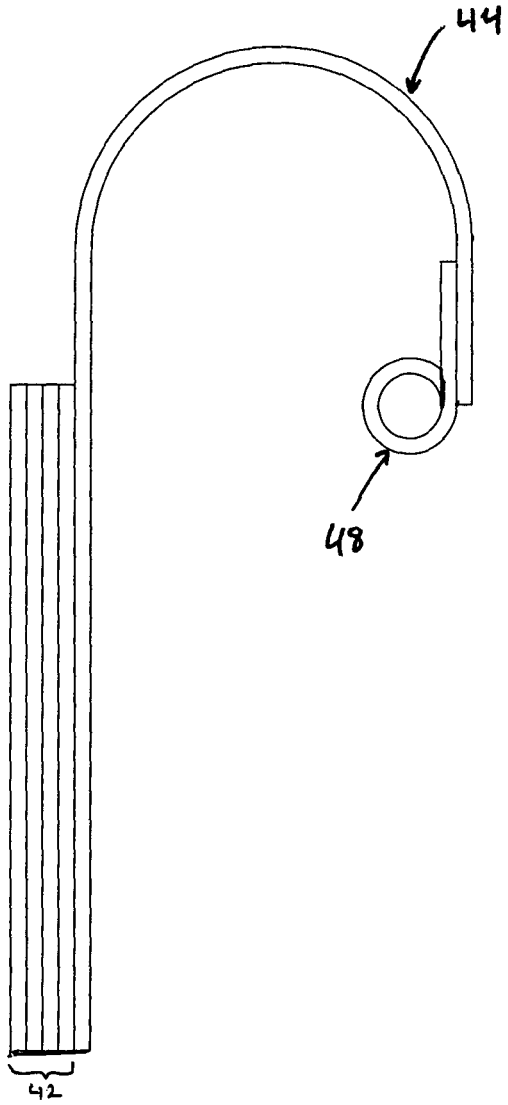
FIGS. 9 and 10 show side and top views of a barrier post for use in the invention.
Figure 10:
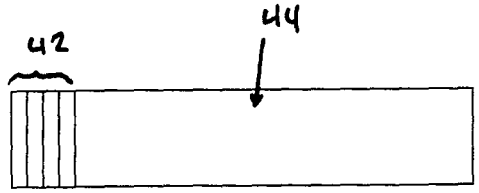

Referring to FIGS. 9 and 10, side and top views of a barrier post 10*a* for use in the invention are shown. The barrier post 10*a* comprises a plurality of straight strips 42 of spring steel and a hook shaped strip of spring steel 44 (an alternative arrangement comprises one thick barrier post). The strips of spring steel are positioned adjacent one another but are not attached to one another. In this way, as the post bends when the post is impacted, adjacent surfaces of the strips can slide over one another as they deflect, and can then substantially return to their original positions (providing the post is not deformed beyond its elastic limit). The post 10*a* has a rolled eye 48 attached to the inner surface of the hook strip 44 which, in use, as the hook bends inwards will come into contact with the upright of the post 10*a* and transfer force directly thereto. In use, under impact, force will be transferred through the barrier post into the footing. As the shaft of the footing is made of a spring steel it has some resilience against deformation which prevents it fracturing under high load. The combined footing 36*a* and post 10*a* function in exactly the same way as described in relation to FIG. 1.

Figure 11:
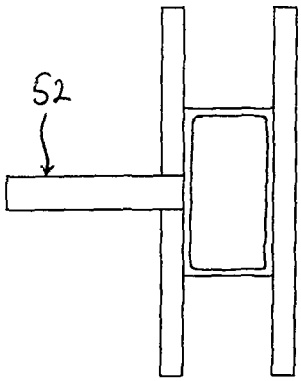
FIGS. 11 to 15 show alternative embodiments of the post footing according to the invention.
Figure 13:
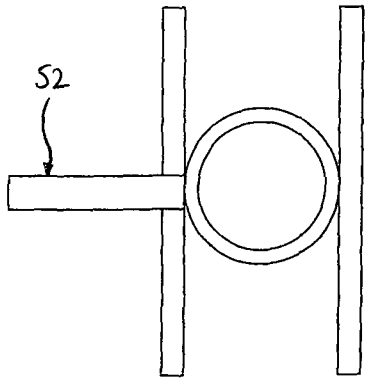
Figure 12:
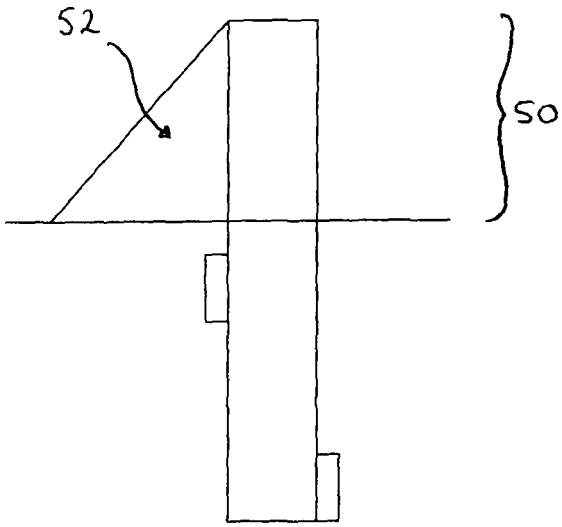

Referring to FIGS. 11, 12 and 13, top and side views of an alternative footing are shown. The footing is substantially as described in relation to FIGS. 3 to 8 and, in addition, the footing has a section 50 that extends above the ground and to which a support plate 52 is attached. The support plate 52 is attached to the rear facing side of the footing away from the direction from which an impact will occur. The support plate 52 is attached to the shaft, preferably by welding. The bottom edge of the support plate is perpendicular to, and substantially in contact with, the surface in which the footing is partially buried. In use, when a post inserted into the footing is impacted, force will be transferred to the rear edge of the footing. Where the footing extends above ground level, there is a possibility that this face will split open, or damage the back surface of the footing. By attaching the support plate 52 to the section 50 of the footing above the ground, when impacted a force will be transferred through the back edge of the footing, through the support plate and into the ground. The reactant force will act in the opposite direction and give support to the back of the post and help to prevent damage thereto.

By this design it is possible to provide a post with an even shallower footing, e.g. 100 mm to 200 mm, which is effective for lighter weight security barriers, for example for stopping slow moving vehicles in car parks. FIG. 12 shows a top view of such a post footing having a square section and FIG. 13 shows a top view of such a post footing having a round cross section.

Figure 14:
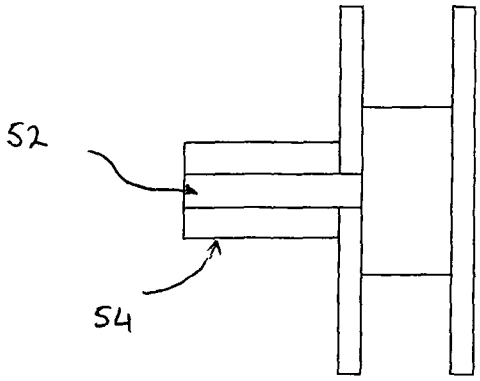
Figure 15:
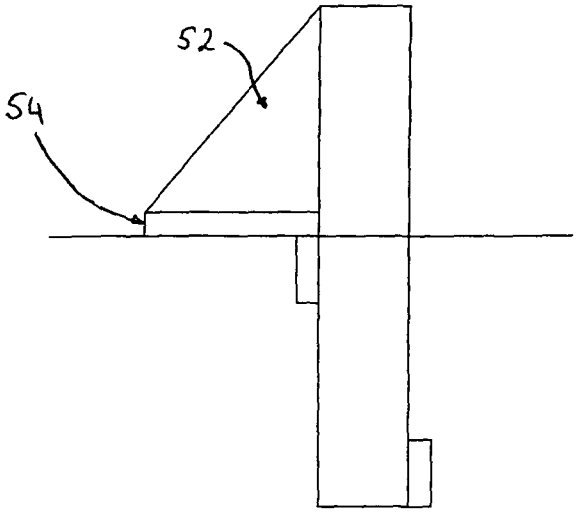

Referring to FIGS. 14 and 15 an alternative design of the footing shown in FIGS. 11 and 12 is shown. In addition to the features described above in relation to FIGS. 11 and 12, the footing post comprises a distribution plate 54 attached substantially perpendicularly to the lower edge of the support plate 52. In use, the distribution plate 54 acts to distribute the force acting through the plate 52 over a wider area, thereby reducing the pressure applied on the ground. Although depicted in relation to a footing having a square cross section, such a distribution plate could of course equally be used with the footing of FIG. 13 having a circular cross section.

Figure 16:
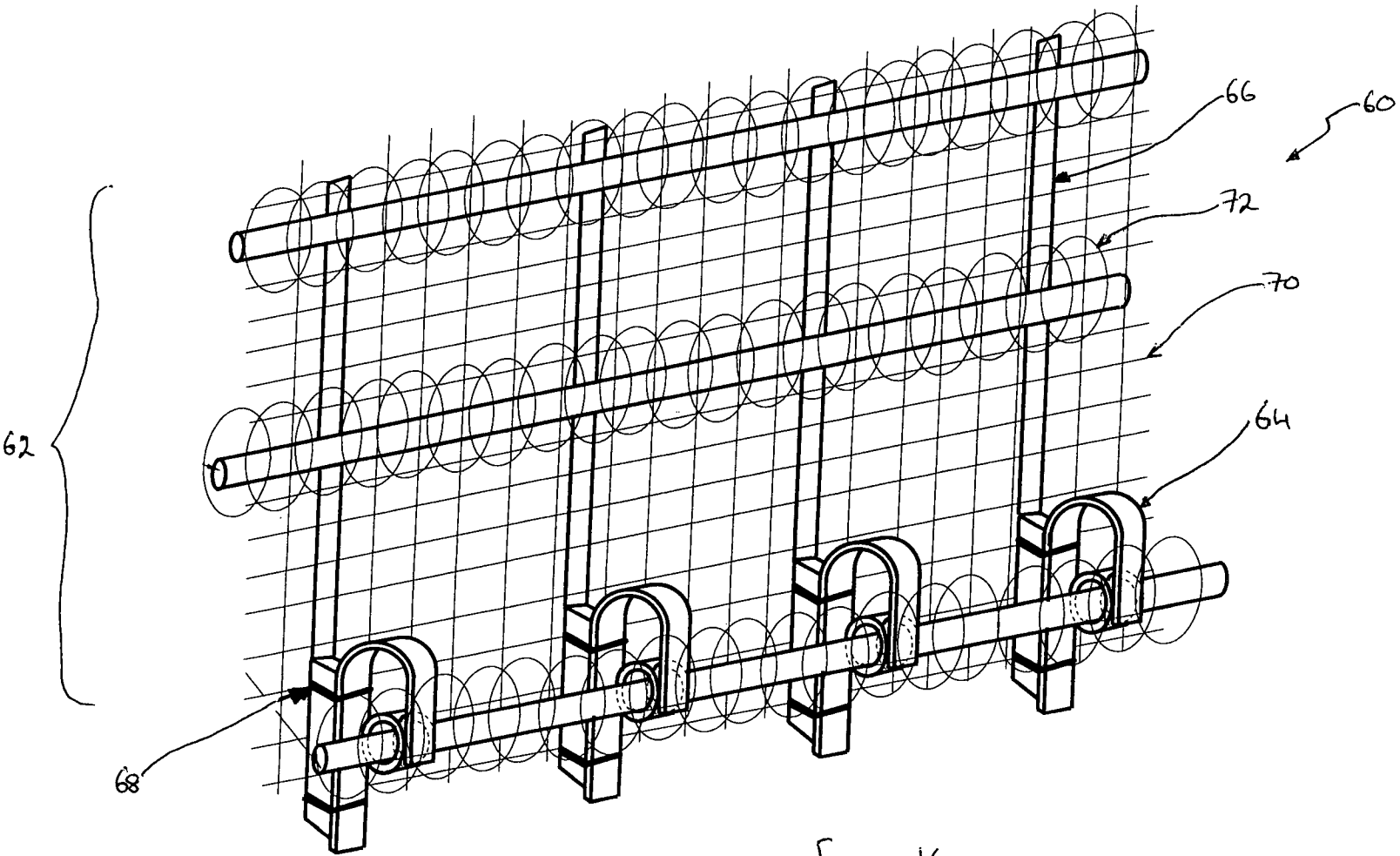
FIGS. 16 and 17 show barriers in accordance with the invention having secondary fences.

FIG. 16 shows a security barrier 60 according to the invention having a secondary fence 62. The barrier 60 depicts the above ground section of the barrier and it will be appreciated that the barrier 60 also comprises footings according to any embodiment of the invention below the ground level (omitted for clarity). The barrier 60 comprises a plurality of barrier posts 64 which are substantially hook shaped as described above. Attached to the barrier posts are a plurality of secondary posts 66 which extend vertically therefrom. The secondary posts 66 are preferably attached to the barrier posts using U-bolts 68 that pass around the barrier posts 64. In this manner the structural soundness of the barrier posts 64 is not compromised by having to drill into them to attach the secondary posts 66. The secondary posts 66 have a fence 70 attached thereto. In this manner, as well as providing a security barrier for vehicles or the like, the barrier according to the invention can simply be modified to also provide a pedestrian barrier. As depicted, razor wire 72, or the like, may easily be added to the fence barrier 60 to discourage pedestrians from attempting to climb over the barrier. By adapting the security barrier to also have a pedestrian barrier the need for a second set of footings for a pedestrian barrier is avoided.

Figure 17:
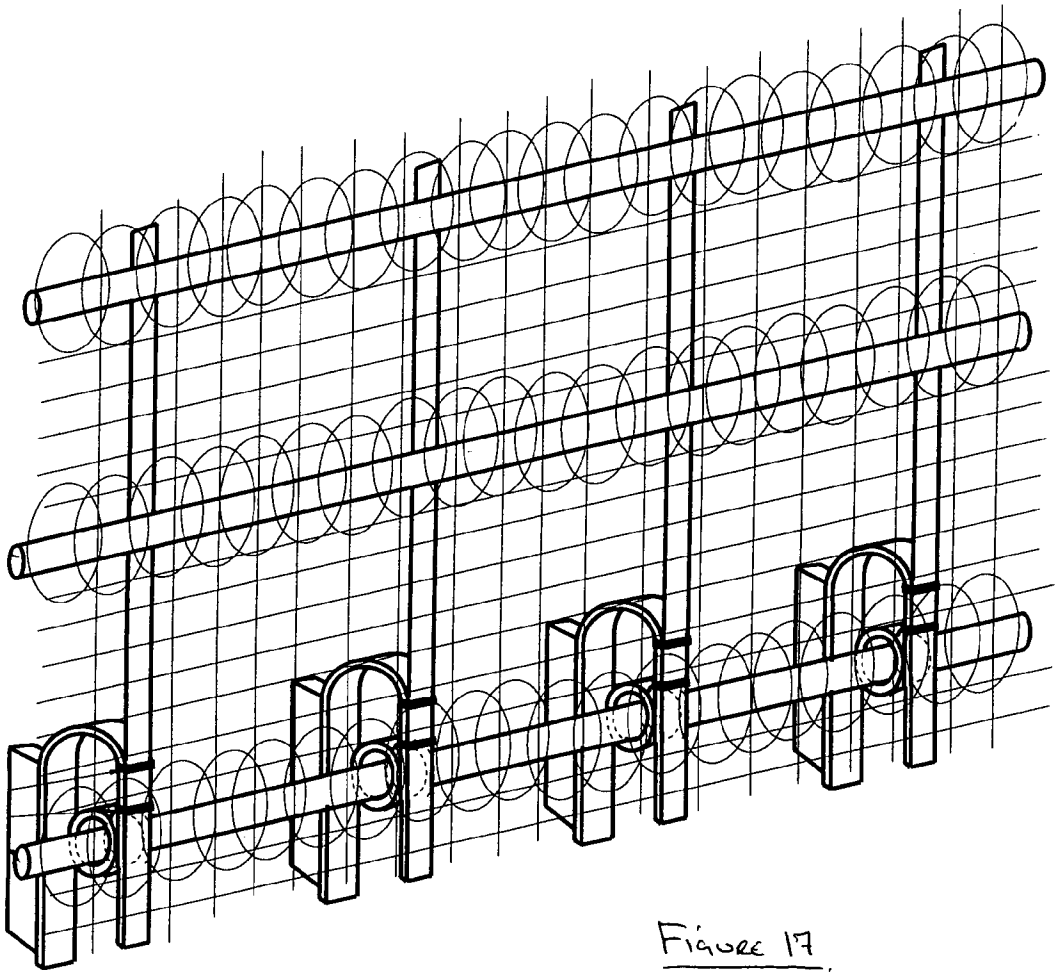

FIG. 17 shows an alternative arrangement in which, instead of being attached to the rear of the barrier posts, the secondary barrier is attached to the front of the barrier posts. Apart form this difference the arrangement is similar to that described above.

Figure 18:
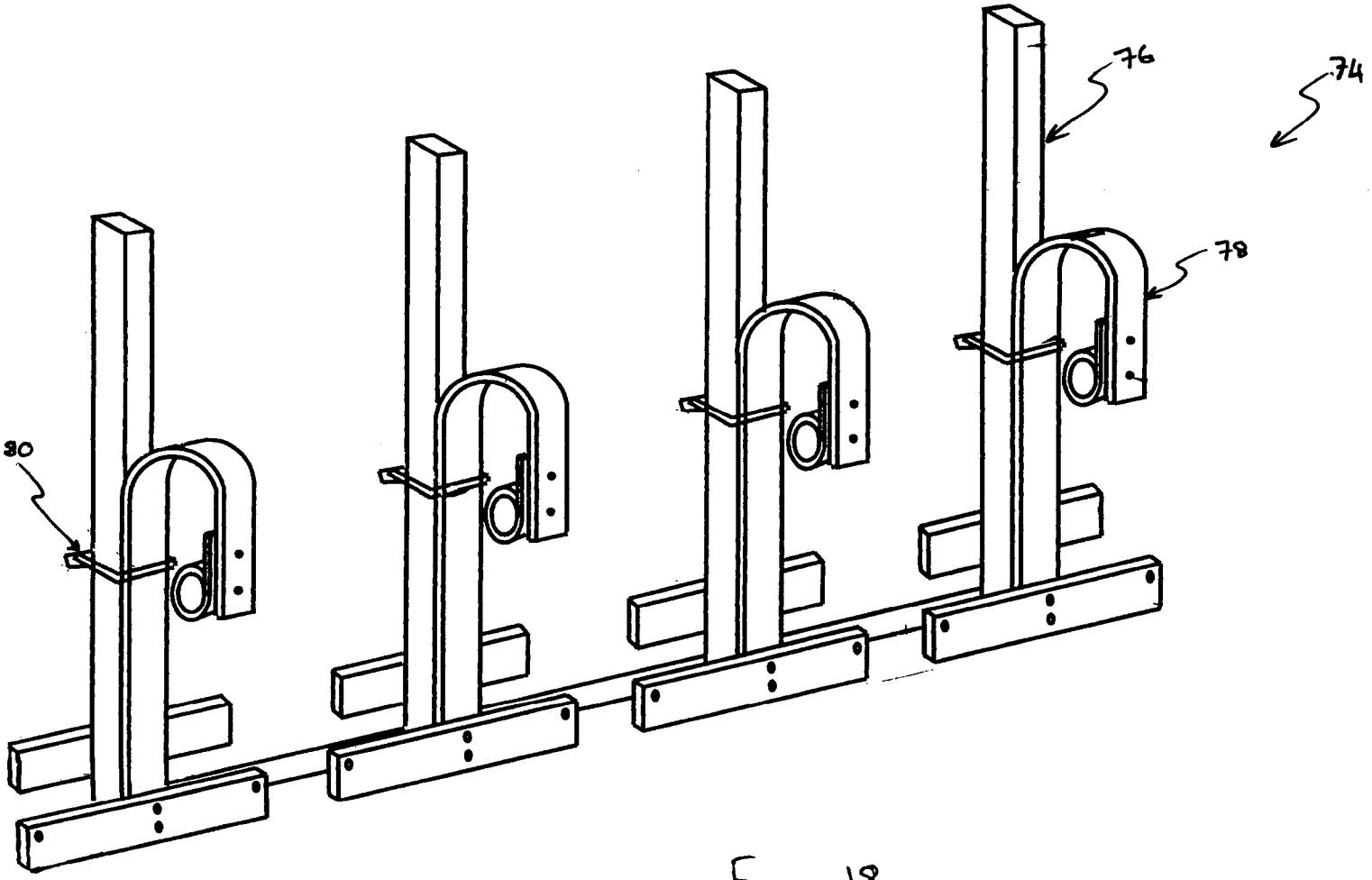
FIG. 18 shows a barrier according to the embodiment with elongated rear sections.

Referring to FIG. 18, a barrier 74, substantially as described in relation to FIG. 2 is shown. Barrier 74 differs from that of FIG. 2 in that the rear sections 76 are elongated and extend substantially vertically from the hook sections 78. In use a barrier of this design is particularly efficient at stopping larger vehicles. In use the front of the vehicle impacts with the hook sections 74 which are approximately 800 mm in height. As the front of the vehicle is deformed by the impact, its inertia will carry it forward until the hook shaped sections 78 contact the front axel of the vehicle. Impact with the axel will shear the axel bolts removing the front axel from the vehicle causing it to drop at the front end as it continues to move forward under inertia. By the time the elongated rear sections 76 impact with the frame of the vehicle behind the cab, sufficient energy will have been removed from the vehicles forward motion that the rear sections 76 will prevent the goods carting part of the vehicle passing the barrier. In this manner zero penetration of the vehicle payload can be achieved. U-bolts 80 may be used to clamp the two parts together.

Referring to FIGS. 19 and 20 a variation rear section 22*a* of the post of FIG. 1 is shown. The rear section 22*a* in this case has an extended lower end 80 that extends substantially perpendicular to the upright part 82 of the rear section to one side thereof. The extended end 80 is formed integrally with the upright part 82 by means of a bend 84. The rear plate 14 is attached as described hereinbefore.

FIG. 21 shows a barrier post 10*a* having the rear section 22*a* as shown in FIGS. 19 and 20. In all other respects the barrier post is the same as described in reference to FIG. 1. The post 10*a* has increased performance over that shown in FIG. 1 in two regards. Firstly, if struck at an angle the extended lower end 80 resists pivotal movement "X" about the bottom of the post and, secondly the increased horizontal surface area provided by surface 86 helps to prevent upward movement of the post 10*a* out of the ground when it is impacted upon.

Referring to FIG. 22 a variation front section 20*a* is shown having an extended lower end 88 that extends substantially perpendicular to the upright part 90 of the rear section in the impact facing direction. The front section in this instance is a straight section rather than the inverted hook shaped section shown in FIG. 1 although the footing variation can equally be used with an inverted hook shaped front section. The extended lower end 88 has a foot plate 18 attached thereto substantially at its distil end. When impacted, the extended lower end 88 and foot plate 18 resist backwards pivotal motion "Y" about the bottom of the footing.

Figure 23:
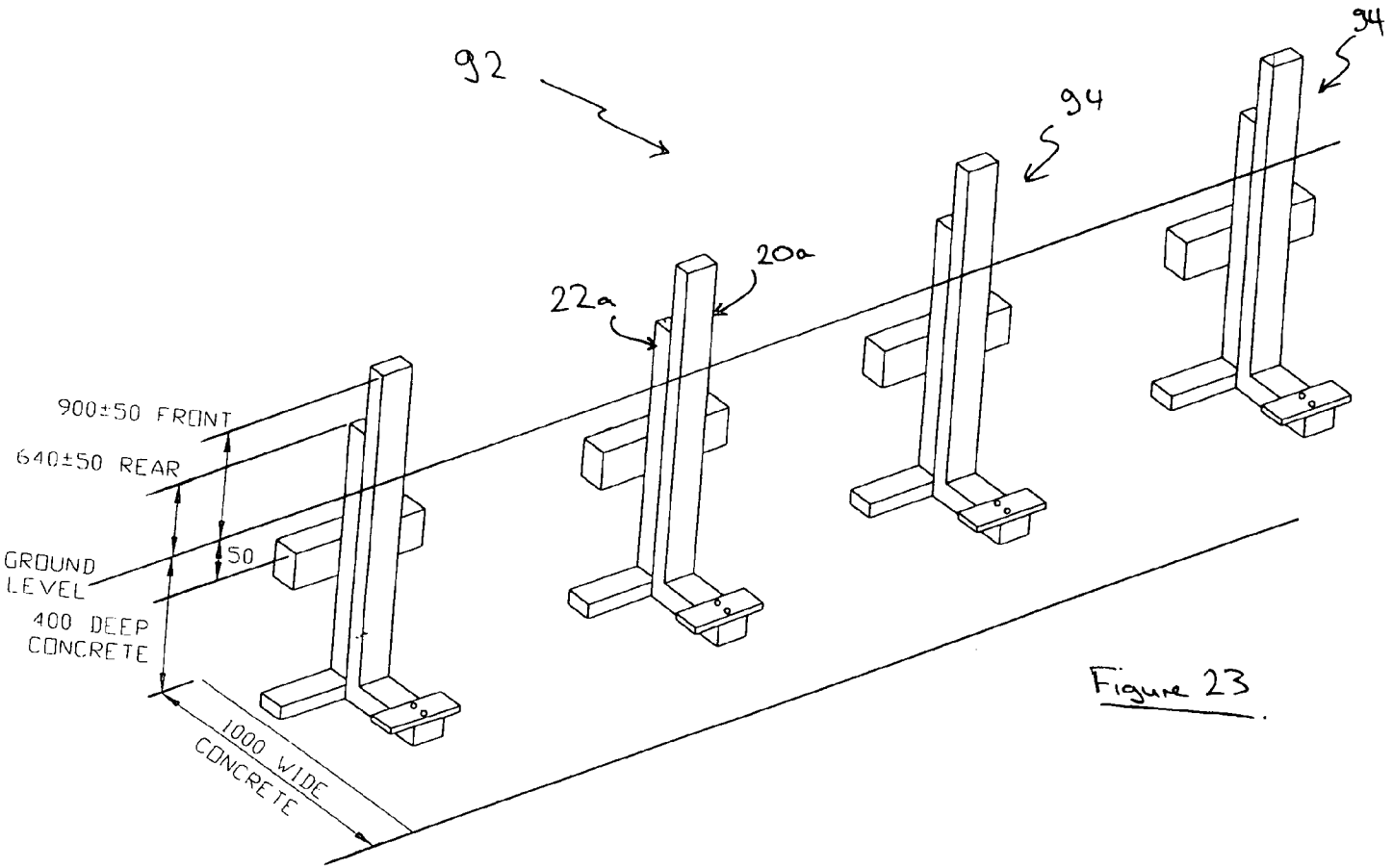
FIG. 23 shows a security barrier having security barrier posts having the rear section shown in FIG. 19 and the front element shown in FIG. 21.

Referring to FIG. 23 a security barrier 92 comprising a plurality of barrier posts 94 is shown. The barrier posts 94 each comprise a rear section 22*a* and a front section 20*a* as described above. The posts 94 are set in a concrete bed approximately 400 mm deep and 1000 mm wide. The posts are set such that the top edge of their rear plates 14 are set approximately 50 mm below the top surface of the concrete bed. The rear sections extend 640 mm+/−50 mm from the concrete, and the front sections extend 900 mm+/−50 mm from the concrete and are spaced with 1200 mm between the posts. Although the post section heights can of course vary, these measurements have proved particularly beneficial, is spreading the load of a large impact thought the post and footing, all of which are constructed of spring steel, to use the natural resilience of the material to absorb the impact without ripping from the ground. In particular the impact loads that this design of barrier can withstand embedded in a bed of only 400 mm makes it particularly beneficial for placing around existing buildings and structures where deeper excavations for laying the concrete bed can interfere with pipelines and cables etc. It is also an advantage of the invention that, although improved impact resistance is achieved through the use of an actual barrier extending between the posts, as an impact load is spread over more posts, the impact resistance of the footing is such that it is, in many circumstances, not necessary. This enables a barrier to be constructed which, while effective fro stopping larger motorised vehicles such as lorries or cars, does not create a pedestrian barrier. Furthermore, due to the compact nature of the posts they can easily be surrounded by an outer cover, for example made of a plastic or metal so as to enhance their aesthetic appearance.

Figure 24:
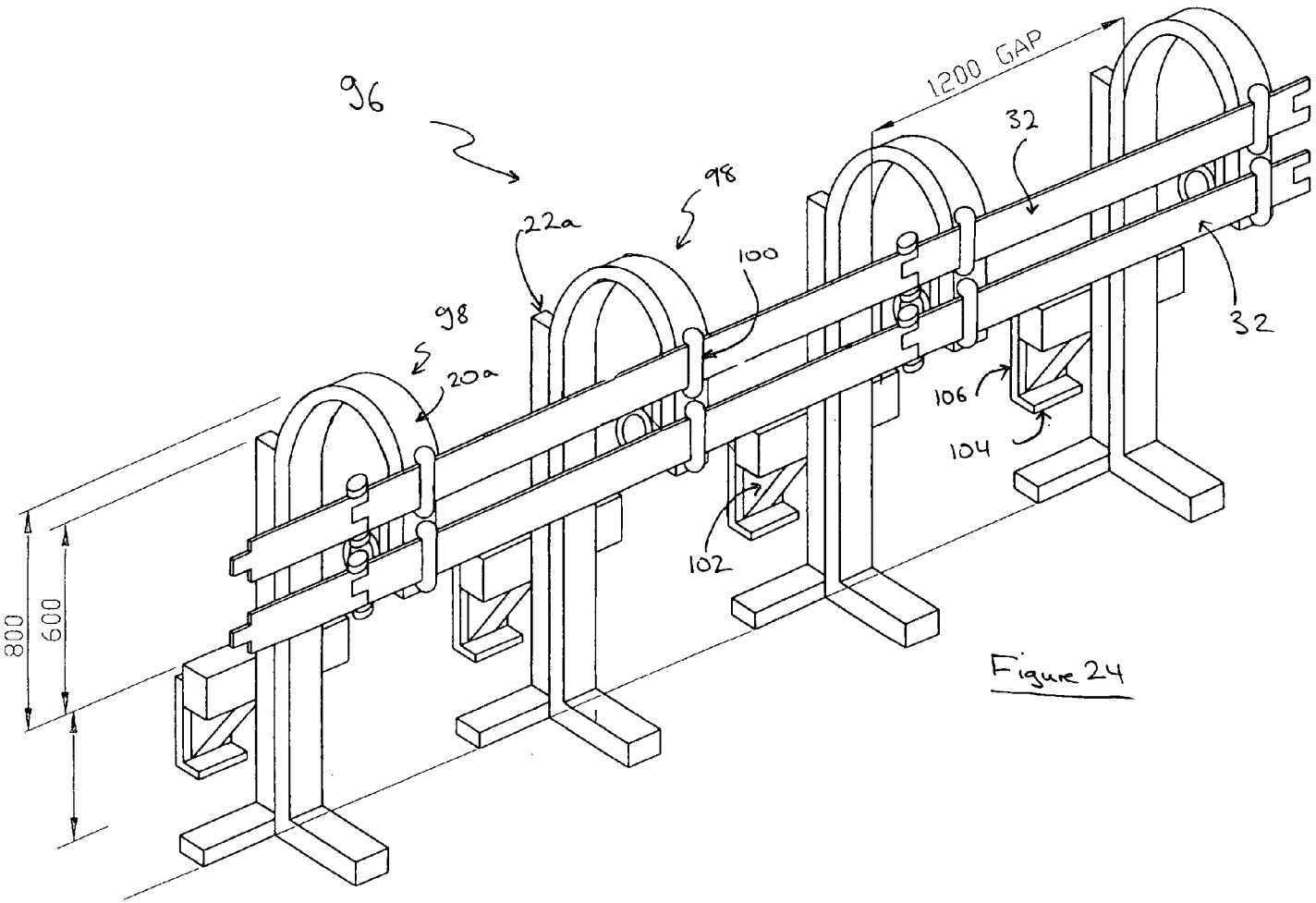
FIG. 24 shows a barrier according to the invention.

Referring now to FIG. 24 a barrier 96 is shown comprising a plurality of barrier posts 98 each having a front section 20*a* and a rear section 22*a*. In this case the above ground sections of the front sections 20*a* are as described with reference to FIG. 1. Hinged barrier plates 32 are attached to the front of the posts by U-bolts 100. The barrier posts 98 have underground rear support plates 102 attached to a rear facing surface of the rear sections 22*a*. The support plates 102 have a first load distribution plate 104 attached to the lower edge thereof substantially horizontal to the ground, and have a second load support distribution 106 plate attached to the rear edge thereof substantially horizontal to the ground such that that both the horizontal and vertical component forces of any impact transmitted through the support plate 102 into the distribution plates 104, 106 acts over an enlarged surface area. In all other respects the functions of the remainder of the features of the barrier function as described above.

Figure 25:
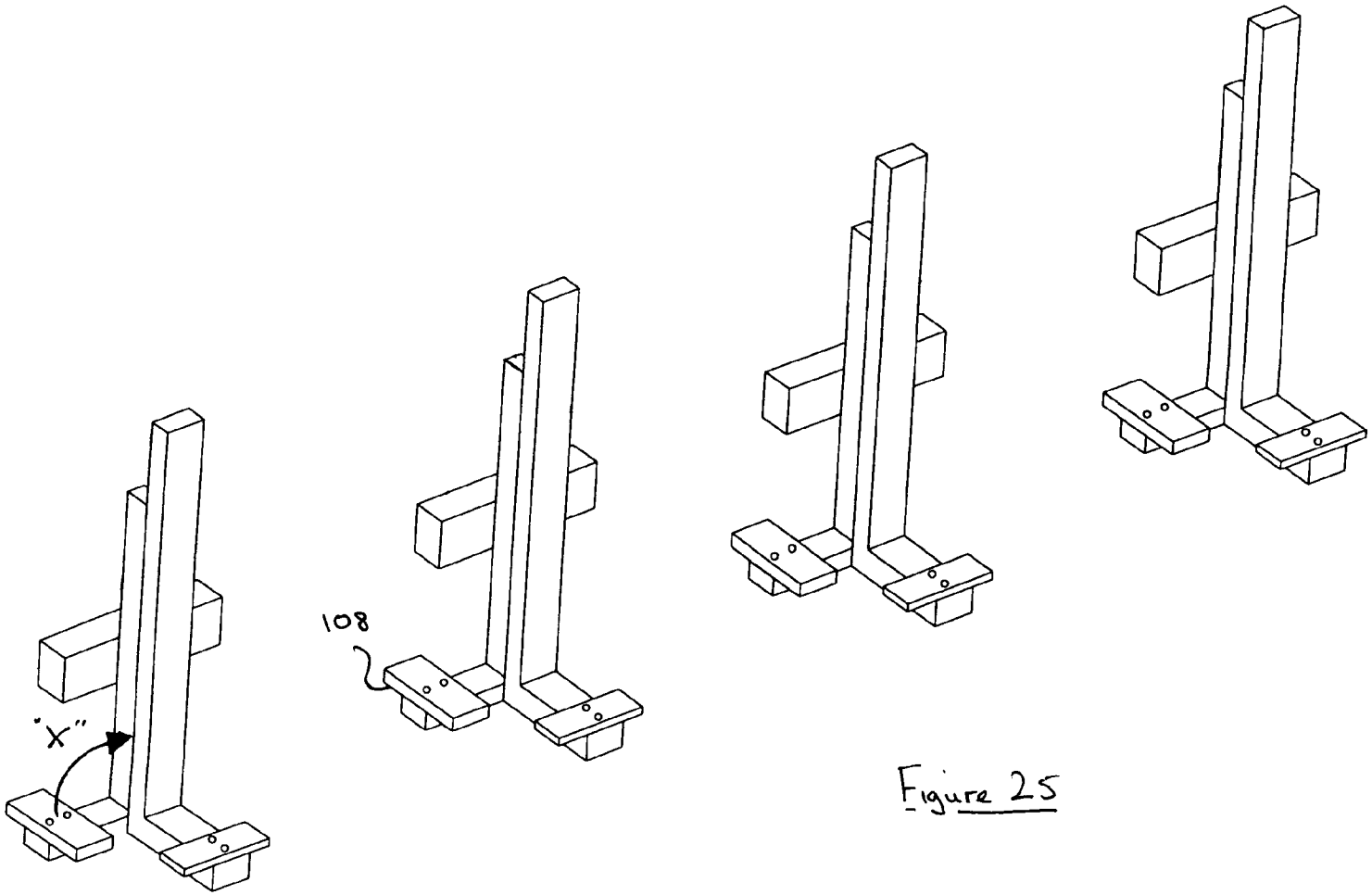
FIG. 25 shows a variation of the barrier of FIG. 23.

Referring now to FIG. 25 the barrier of FIG. 23 is shown with an additional load plate 108 attached to the security barrier post footings thereof. This extra load plate 108 assists in anchoring the footing in the event of the post being impacted from an oblique direction as it assists in absorbing sideways rotational force "X".

Figure 26:
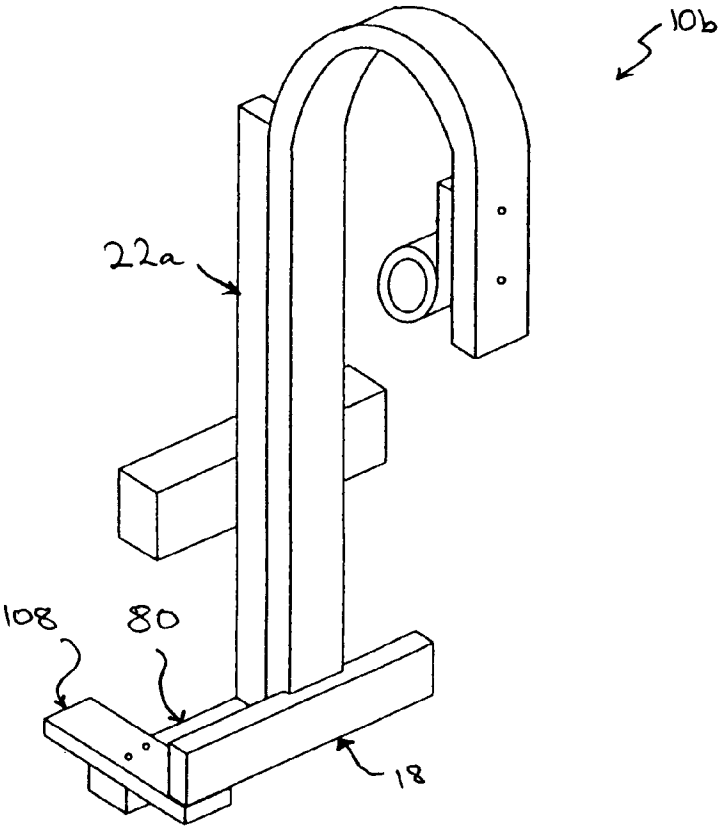
FIG. 26 shows an alternative security barrier post in accordance with the invention.

Referring to FIG. 26 a security barrier post 10*b* is shown that is a variant of the post 10*a* shown in FIG. 21. Post 10*b* further includes an additional load plate 108 attached to the extended lower end 80 of rear section 22*a*. The end op the load plate 108 extends under the end of foot plate 18. Load plate 10 and foot plate 18 may be immediately adjacent one another but are not joined to one another such that, in the event of an impact they are free to slide over one another without the shear forces occurring that would be present were they to be joined.

Figure 27:
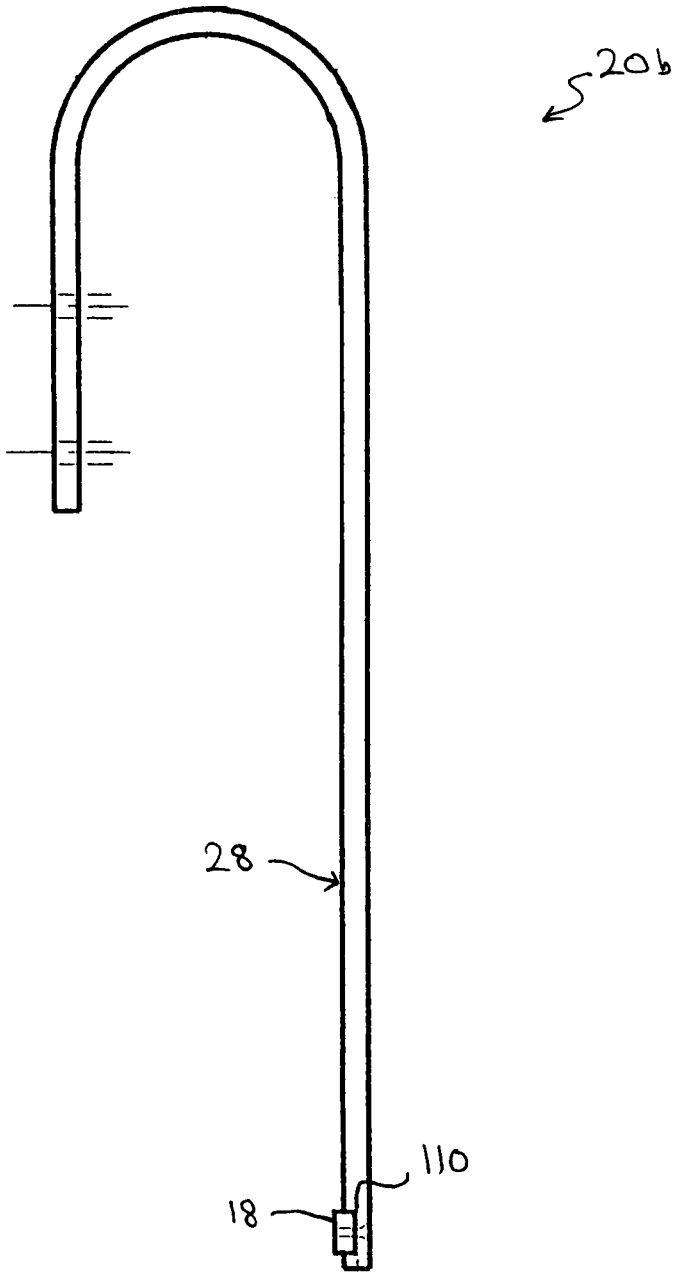
FIG. 27 shows a front section of a barrier post in accordance with the invention.
Figure 29:
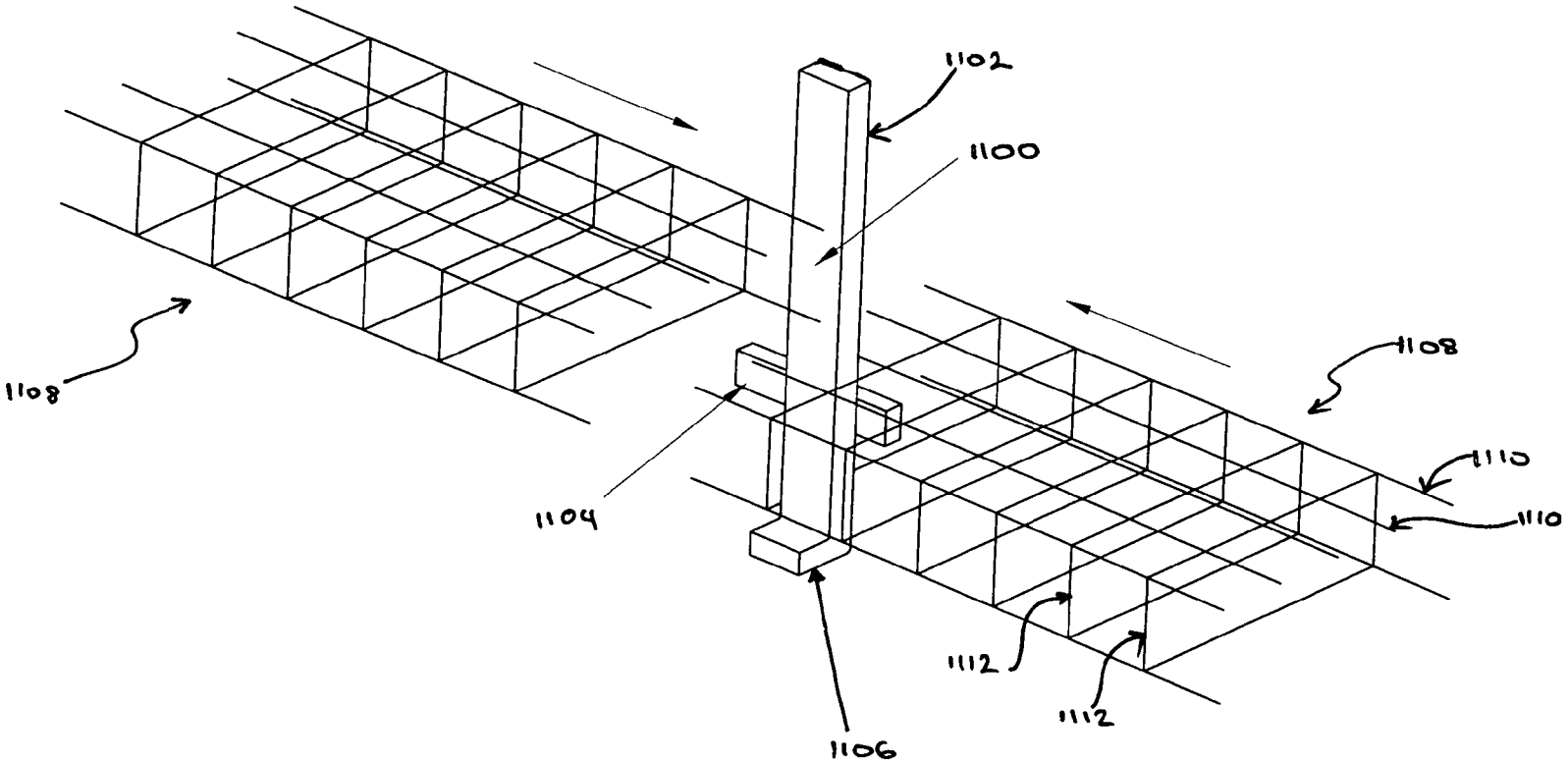
FIG. 29 shows a schematic view of a security barrier post and footing in accordance with the invention.
Figure 30:
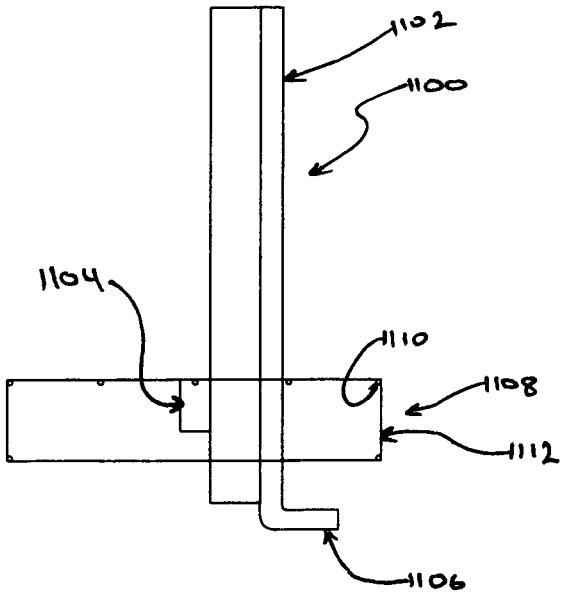
FIG. 30 shows a side view of a security barrier post and footing according to the invention.
Figure 31:
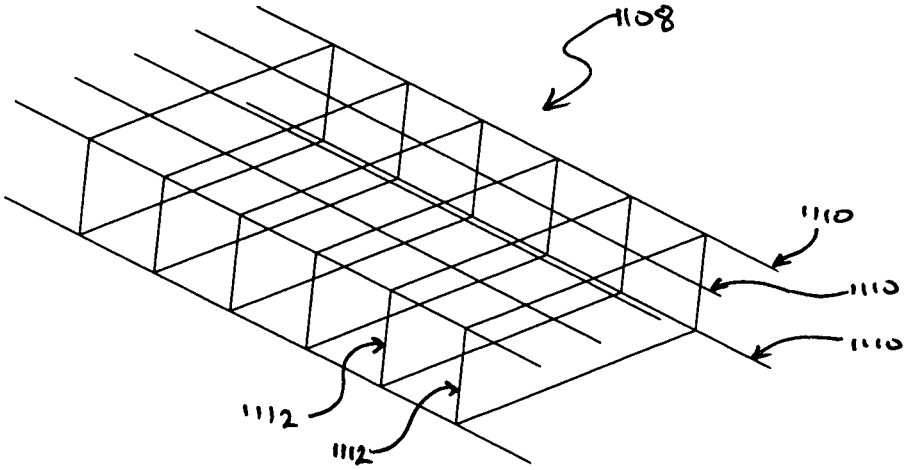
FIG. 31 shows a perspective view of a reinforcement cage in accordance with the invention.
Figure 32:
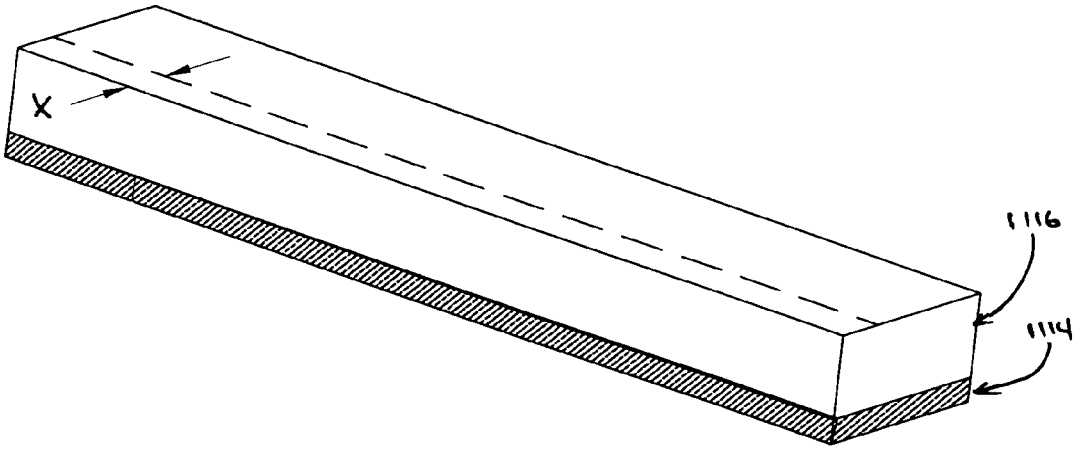
FIG. 32 shows a concrete bed in accordance with the invention.

Referring to FIG. 27 a variation 20*b* of the front section 20 is shown. The front face 28 has a recess 110 therein at its lower end in which the foot plate 18 is received. When the front section 20*b* is impacted the resultant force thereon attempts to lift the section out of the ground. In the embodiment shown in FIG. 1 wherein the foot plate 18 is bolted to the front section 20 it is possible that, as the upwards force on the front section is transferred into the foot plate 18 via the bolts, this will result in the bolts shearing, thereby allowing the post to lift from the ground. By recessing the front section 20*b* and setting the foot plate 18 in that recess 110, vertical forces can be transferred directly from the front section into the material of the foot plate 18 by the overlapping portions of the recess and the front plate 18, thereby removing the reliance on additional mechanical connectors to hold the two parts together. The improved strength of this connection results in improved retaining force of the post and enables it to be impacted by greater forces without it ripping from the ground.

Figure 28:
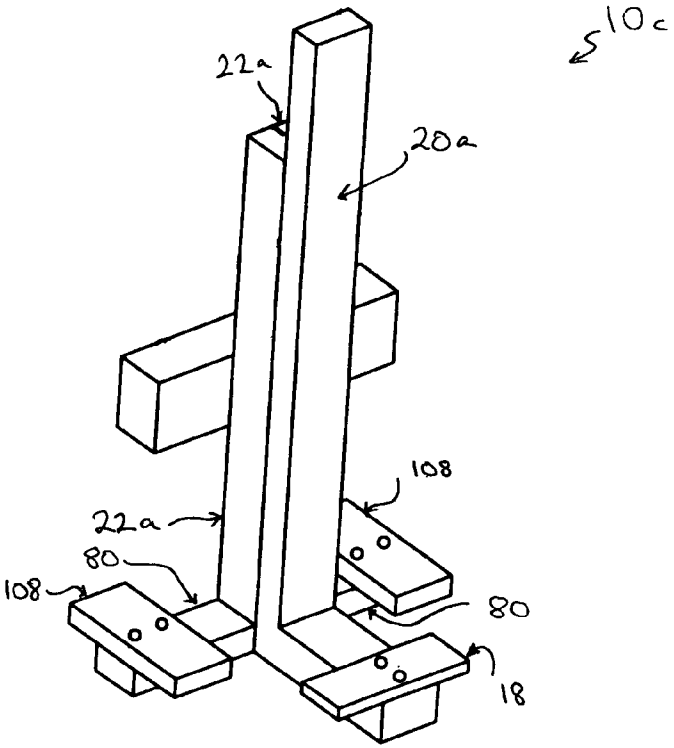
FIG. 28 shows a further alternative security barrier post in accordance with the invention.

Referring to FIG. 28 an alternative security barrier post 10*c* is shown. In this arrangement a front section 20*a* having a front plate 18, as described above, is located adjacent two rear sections 22*a*, each with an extended lower end 80, the extended lower ends extending in opposite directions from one another. In this embodiment the use of two rear sections 22*a* further increases the resistance of the footing to being ripped out of the ground on impact. Load spreader plates 108 may be used with this arrangement.

Referring to FIGS. 29 to 32, a security barrier post 1100 is shown comprising a substantially vertical shaft 1102 having a back plate 1104 and a foot plate 1106 both arranged substantially perpendicular to the shaft 1102 and extending to at least one side thereof. The back plate 1104 is attached to the rear facing side of the shaft 1102 away from which an impact will occur and the foot plate 1106 is towards the lower end thereof, at a position spaced from the back plate 1104. At least the back plate and preferably the entire post is constructed of spring steel.

The barrier is constructed by first digging a trench that is approximately 475 mm deep (not shown) and 1000 mm wide and placing a layer of binding cement 1114 (having a low concrete level) in the bottom of the trench so as to provide a flat and even surface.

The posts 1100 are then located in the trench at approximately 1200 mm to 1300 mm intervals and reinforcement cadges 1108 are located either side thereof. The reinforcement cages 1108 each comprise a plurality of longitudinal members 1110 and a number of cross members 1112 both formed of reinforcement grade steel, as known in the construction industry. The reinforcement cadges 1108 may be welded together or retained together in some other way, e.g. by using steel ties.

The posts 1100 are located at a distance X approximately 300 mm from the front of the trench, ensuring that once the trench is filled with concrete 1116 the majority of the concrete is behind the post when considered from the direction of impact.

Preferably the cross members 1112 are rectangular in shape and are retained in adjacent spaced relation to one another by attachment to a longitudinal member 1110 at each corner thereof. The cage 1108 is further reinforced by a plurality of longitudinal members 1110 that run along its upper surface and which are also attached to the cross members 1112 so as to retain them in spaced relationship. As, during use, a large part of the force of impact is transmitted from the post 1100 into the upper part of the concrete via the back plate 1104, the additional reinforcement in the upper surface of the cage is designed to add strength in this area.

The cross members 1112 are spaced at approximately 200 mm intervals and each cage is approximately 1200 mm from end cross member to end cross member. The longitudinal members 1110 extend either side of the end cross members by 100 mm to 200 mm so that, when cages 1108 are placed either side of the post 1100, the longitudinal members 1110 extending to the end of the cages 1108 overlap one another. In this manner, although the reinforcement comprises a number of small cadges rather than long bars, there is no break in the reinforcement provided to the concrete structure in a direction perpendicular to the longitudinal axis of the trench.

As can be seen from FIGS. 2 and 3 the reinforcement cages 1108 are fairly shallow and do not extend to the bottom of the trench, although they of course could do. As a large portion of the force of an impact is dissipated in the upper part of the concrete bed then by limiting the reinforcement to this area, the cages 1108 are smaller and easier to handle. In a preferred embodiment the cages are approximately 260 mm high and 875 mm deep. By maintaining the reinforcement in the area in which the post footing disperses the energy from an impact the reinforcement cages 1108 are kept small and can be manhandled into place without the need for large machinery. This contributes to the ease of installation and avoids disruption where the barriers are being installed in busy areas, for example around embassies or other governmental buildings in city centres.

Once the barrier posts 1100 and the reinforcement cages 1108 are located in the trench concrete to an appropriate class for the prevailing ground conditions is poured into the trench to a level that covers the top of the reinforcing cages 1108 and the back plate 1104.

While specified dimensions are given it will be appreciated that the dimensions of the reinforcing cages 1108 may be varied and that although shown that adjacent posts of a barrier are separated by only one cage, the same effect could be achieved by two smaller cages which overlap at a central join in a similar manner to the cages meeting adjacent the barrier posts. Furthermore, while illustrated as being a straight security barrier post it will be appreciated that the part of the barrier post extending from the ground may be any shape, for example inverted hook shaped, and that the barrier may be enhanced by the provision of a secondary barrier extending between the barrier posts above the concrete.

Although a post as described above could of course have a footing of any depth, the design may enable a post having a footing of a lesser depth to receive a far greater impact than traditional posts and therefore may stop a vehicle moving at a higher speed.

Installation of security barriers having footings as described herein that have equivalent stopping power to existing security barriers may be more quickly and easily implemented due to the reduced need for deep footings.

It will be appreciated by the person skilled in the art that the various features of the various embodiments may be used in other embodiments, for example where examples of hook shaped barrier posts are given they could equally be replaced with straight posts and vice versa. Furthermore, any of the rear sections can be used in combination with any of the front sections as described herein.

It is also anticipated that the security barrier posts described herein may be used to support any components of a security barrier, in particular movable portions of a security barrier, for example a gate. Where used to support a gate the gate bay be pivotally mounted on the posts of the invention or may, for example lift upwards to remove the at least one post from its footing to allow the gate to be moved to allow an authorised vehicle to cross the barrier.

It will also be appreciated that traditional reinforcing means, for example the use of steel reinforcement, may be used in the concrete bed.

The invention claimed is:

1. A security barrier post comprising:

an underground footing comprising:

a substantially vertical shaft having an impact facing side which is positioned to receive an impact, a rear facing side opposite to the impact facing side, a spring steel back plate and a spring steel foot plate both arranged substantially perpendicular to said shaft and extending to at least one side thereof, wherein said footing is configured to be at least partially buried; said back plate is attached to the rear facing side of the shaft and is configured to be buried below a surface when said footing is at least partially buried such that said back plate is flush with or slightly below the surface, and said foot plate is located towards the lower end of said shaft, at a position vertically spaced from said back plate such that, under impact, the joints between said foot plate and said shaft, and between said back plate and said shaft are compressed; and a barrier post that extends above said surface comprising a plurality of vertical spring steel elements, that are not joined together at their upper ends, aligned between the impact facing side of the shaft and said rear facing side of said shaft.

2. A security barrier post according to claim 1 wherein said shaft comprises a hollow section for receiving said barrier post therein.

3. A security barrier post according to claim 2 wherein said hollow section is made of spring steel.

4. A security barrier post according to claim 1 wherein said footing further comprises:

an underground rear support plate attached to said rear facing surface of the shaft, said plate extending in a rearward direction therefrom; and a first load distribution plate attached to the lower edge of said underground rear support plate substantially horizontal to the ground.

5. A security barrier post according to claim 1 wherein said shaft comprises a front section and at least one rear section, wherein said back plate is attached to said rear section.

6. A security barrier post according to claim 5 wherein the foot plate is attached to the front section.

7. A security barrier post according to claim 1 wherein said substantially vertical shaft has a recess on the impact facing side towards the lower end thereof and said foot plate is located at least partially within said recess.

8. A security barrier post according to claim 5 wherein said at least one rear section comprises a substantially vertically arranged piece of spring steel, the lower end of the substantially vertically arranged piece of spring steel is bent through substantially 90 degrees such that the lower end extends sideways therefrom substantially parallel to said back plate.

9. A security barrier post according to claim 8 wherein said sideways extending lower end has a horizontal plate substantially perpendicular to, and adjoining, to the upper surface thereof.

10. A security barrier post according to claim 9 wherein said sideways extending lower end forms said foot plate.

11. A security barrier post according to claim 5 wherein said front section comprises a substantially vertically arranged piece of spring steel, the lower end of the substantially vertically arranged piece of spring steel is bent through substantially 90 degrees such that the lower end extends therefrom in the impact facing direction.

12. A security barrier post according to claim 10 further comprising a front plate attached substantially at the distal end of said bent section.

13. A security barrier post according to claim 8 comprising two rear sections, the extended lower ends of said two rear sections extending in opposite directions.

14. A security barrier post according to claim 1 wherein said footing comprises a first section which is configured to be buried and a second section that is configured to extend substantially vertically above the ground when the first section is buried, said second section having a vertical support plate attached to a rear facing surface thereof, said vertical support plate extending in a rearward direction therefrom, and arranged such that the lower edge of the plate is adjacent to, or partially embedded in, said surface in which the footing is buried; and a load distribution plate attached to the lower edge of said support plate substantially perpendicular to the ground such that any force transmitted through said support plate into said distribution plate acts in a substantially downwardly direction and acts over the area of said distribution plate.

15. A security barrier post according to claim 1 wherein said footing and said barrier post are integral.

16. A security barrier post according to claim 1 wherein said plurality of vertical spring steel elements comprise at least an impact facing front section and a rear section, wherein said front section extends substantially vertically above said rear section.

17. A security barrier post according to claim 1 wherein said post further comprises attachment means for attaching a secondary post thereto; an elongate secondary post, attached to said security barrier post, said secondary post extending substantially vertically above said security barrier post; and a secondary barrier attached to the secondary post.

18. A security barrier comprising a plurality of security barrier posts according to claim 1 arranged adjacent to one another.

19. A security barrier according to claim 18 wherein the back plates of adjacent ones of the security barrier posts are joined to one another and the foot plates of adjacent ones of the security barrier posts are joined to one another.

20. A security barrier according to claim 18 where the back plates of adjacent ones of the security barrier posts are integral and the foot plates of adjacent ones of the security barrier posts are integral.

21. A security barrier according to claim 18 further comprising:

a concrete bed in which said underground footing is received, said concrete bed including a plurality of reinforcement cages, each said reinforcement cage comprising a plurality of cross members and a plurality of longitudinal members, said longitudinal members extending outwardly from at least one side of said cross members of each cage; wherein said longitudinal cross members of one reinforcement cage overlap with said longitudinal cross members of an adjacent reinforcement cage.

22. A security barrier according to claim 21 wherein said longitudinal members extend to both sides of said reinforcement cage, and the longitudinal cross members of one reinforcement cage overlap with the said longitudinal cross members of an adjacent reinforcement cage.

23. A method of building a security barrier comprising a plurality of security barrier posts and a concrete bed in which said underground footings of said security barrier posts are received; each said security barrier post comprising: an underground footing comprising: a substantially vertical shaft having an impact facing side which is positioned to receive an impact, a rear facing side opposite to the impact facing side, a spring steel back plate and a spring steel foot plate both arranged substantially perpendicular to said shaft and extending to at least one side thereof, wherein: said footing is configured to be at least partially buried, said back plate is attached to said rear facing side of said shaft and said back plate is configured to be buried below a surface when said footing is at least partially buried such that said back plate is flush with or slightly below said surface, and said foot plate is located towards the lower end of said shaft, at a position vertically spaced from said back plate such that, under impact, the joints between said front plate and said shaft, and between said back plate and said shaft, are compressed; and a barrier post that extends above said surface comprising a plurality of vertical spring steel elements, that are not joined together at their upper ends, said plurality of vertical spring steel elements aligned between said impact facing side of said shaft and said rear facing side of said shaft; and wherein said concrete bed includes a plurality of reinforcement cages, each said reinforcement cage comprising a plurality of cross members and a plurality of longitudinal members, said longitudinal members extending outwardly from at least one side of said cross members of each said cage; wherein said longitudinal cross members of one said reinforcement cage overlap with said longitudinal cross members of an adjacent said reinforcement cage;

the method comprising the steps of:

excavating a shallow trench, locating said plurality of said post footings within said trench such that said footing is at least partially within said trench;

inserting said reinforcement cages to either side of said at least one barrier post footing such that adjacent said reinforcement cages overlap one another in the region of, or adjacent to, said footing; and filling said trench with concrete to form said concrete bed such that said back plate of said footing is located at a position that is flush with or slightly below a surface of said concrete.

24. The method according to claim 23 wherein said longitudinal reinforcing bars of each said reinforcement cage extend either end thereof such that when two said reinforcement cages are positioned adjacent one another in said trench said longitudinal reinforcement bars overlap.

25. The method according to claim 23 wherein said security barrier post footing is located in the forward half of said concrete bed which will receive the impact.

* * * * *